United States Patent [19]

Eastcott et al.

[11] 4,345,123

[45] Aug. 17, 1982

[54] SELF-ADJUSTING BRAKE ENGINE LIMIT SWITCH ASSEMBLY

[75] Inventors: Peter deH. Eastcott; Peter T. Truman; Serge L. Scuccato, all of Peterborough, Canada

[73] Assignee: Canadian General Electric Company Limited, Toronto, Canada

[21] Appl. No.: 190,216

[22] Filed: Sep. 24, 1980

[51] Int. Cl.[3] ..... H01H 3/16

[52] U.S. Cl. ..... 200/52 R; 200/47; 200/61.44; 84/1.11

[58] Field of Search ..... 200/52 R, 61.4, 61.41, 200/61.44, 47, 153 T; 188/1.11; 340/52 A

[56] References Cited

U.S. PATENT DOCUMENTS

| | | | |
|---|---|---|---|
| 2,566,824 | 9/1951 | Carlson | 200/47 |
| 3,218,403 | 11/1965 | Le Wan | 200/47 |
| 3,715,530 | 2/1973 | Dalton | 200/47 |
| 3,776,329 | 12/1973 | Hope et al. | 340/52 A X |
| 3,783,210 | 1/1974 | Spooner | 200/61.4 |

*Primary Examiner*—James R. Scott
*Attorney, Agent, or Firm*—R. A. Eckersley

[57] ABSTRACT

The self-adjusting limit switch assembly of this invention has two switches mounted on a slide for sliding movement on a bracket. A transverse slot in the slide has two facing surfaces. The switches are mounted on each side of the slot with their operating members extending slightly past the slot. The actuator is positioned to extend into the slot. When the brakes are first moved to the brake released position the actuator engages not only the operating member of the switch on that side, but also a wall of the slot and moves the slide to a brake released position thereby correctly adjusting the position of the switches. When the brakes require adjustment due to wear, the actuator engages the operating member of the second switch, as before, causing an indicator to function.

2 Claims, 6 Drawing Figures

FIG. 1.
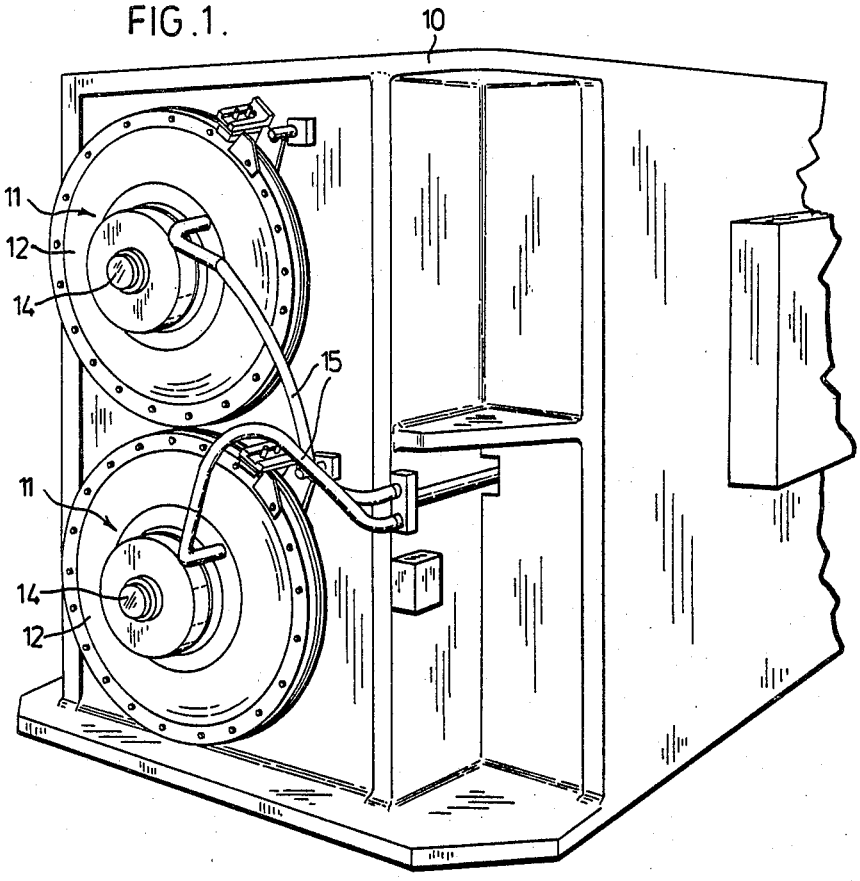
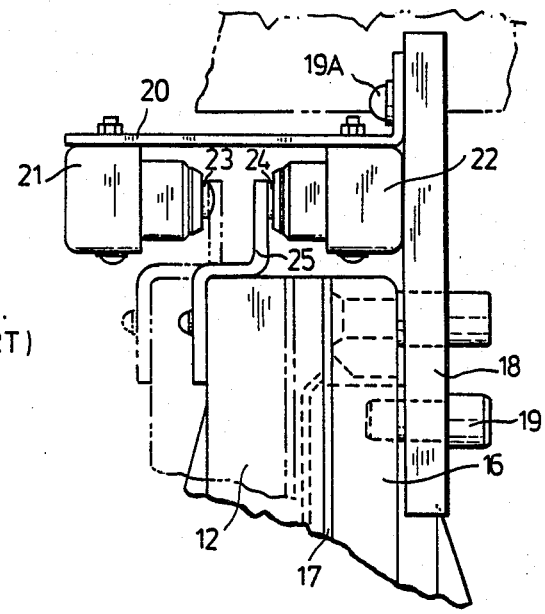
FIG. 2.
(PRIOR ART)

FIG. 3.
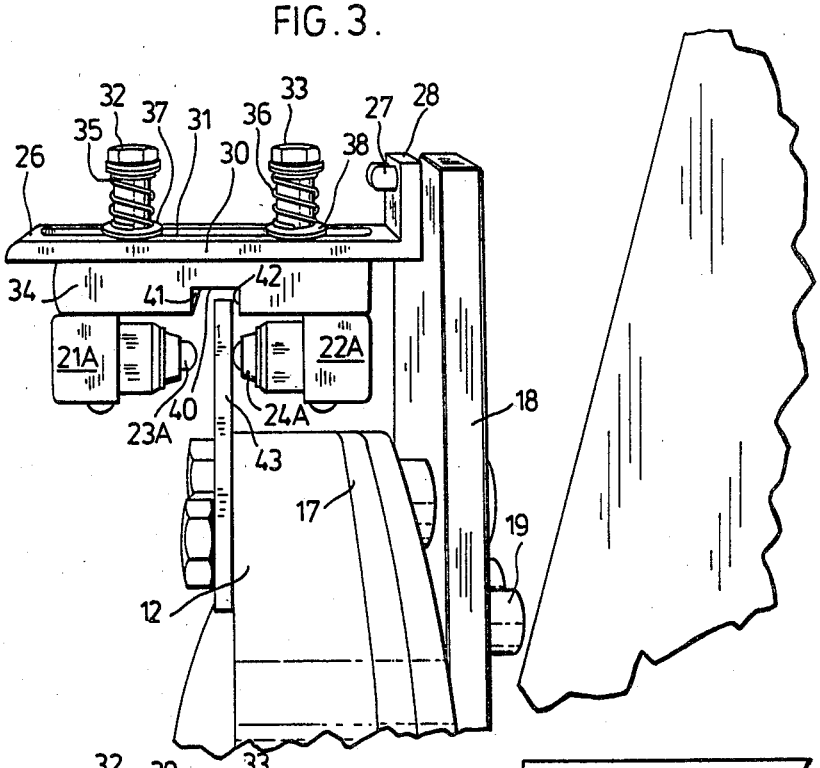
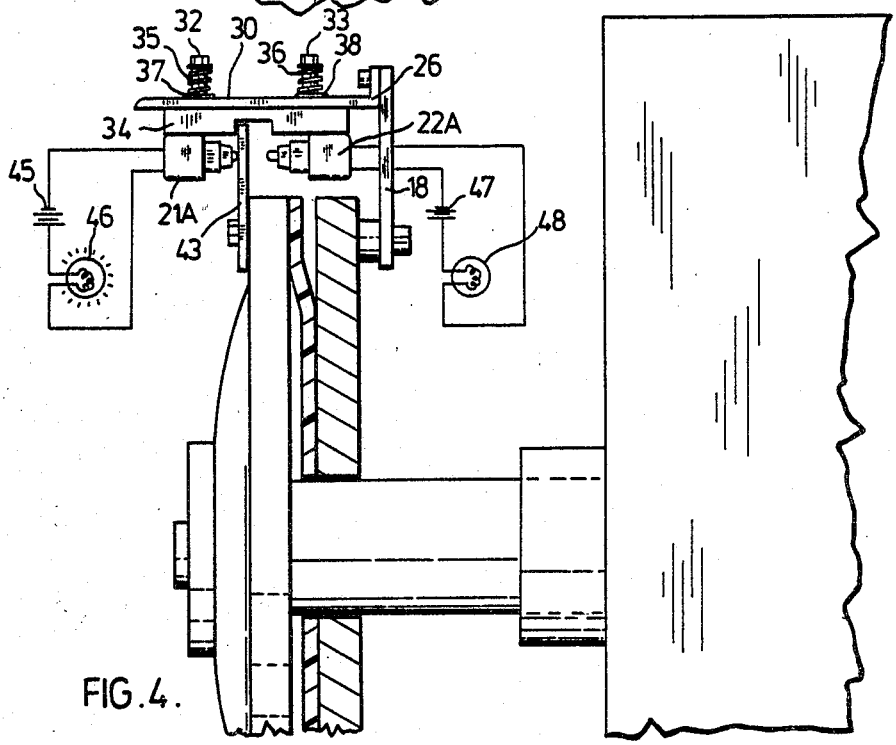
FIG. 4.

SELF-ADJUSTING BRAKE ENGINE LIMIT SWITCH ASSEMBLY

BACKGROUND OF THE INVENTION

This invention relates to brake engine limit switches, and in particular it relates to self-adjusting limit switch assemblies.

It has been found to be desirable to have limit switches associated with brakes in order to indicate when the brake linings require replacement or adjustment and to indicate that the brakes have released properly when brake release is initiated. In large brake systems or brake engines, such as are used for example on mine hoists, it is necessary for safe operation that the brake shoes be kept in adjustment and to replace the brake shoes when they are worn. It is also desirable to provide an indication that the brake has released properly each time and is not dragging. In the past, limit switches have been fixedly mounted to the brake assembly so that a limit switch is operated when the brakes release satisfactorily and a limit switch operates when the brake shoes require adjustment because of wear. Because the limit switches were fixed, they required considerable work to position them accurately when the brake engine was assembled and each time the brakes were adjusted for wear the limit switches were re-positioned.

Referring to FIG. 1, there is shown a portion of a known form of brake engine for a mine hoist having a frame 10 on which are mounted two brake cartridges or brake assembly mechanisms 11. These cartridges 11 carry brake linings which, during braking of a mine hoist, press against one flange or side of a friction wheel (not shown). The frame 10 would normally have mounted on it, to press against the other flange of the friction wheel, an opposing pair of cartridges.

While the invention is being described in connection with use on the brake engine of a mine hoist, it will be apparent it can be used on any large brake engine of the disc type where brake linings are pressed against a flat surface of a moving member.

The brake cartridges 11 have an outer disc member 12 to which is mounted a piston shaft 14. On the inner end of shaft 14 is mounted a brake lining (not shown). The shaft 14 is spring biased inwardly to a brake applying position as is a well known safety feature of a mine hoist brake engine. Air conduits 15 carry air under pressure for moving the disc member 12 with piston shaft 14 outwardly, against the spring bias, to release the brake. There is therefore, a brake released position when disc member 12 has moved outwardly and the brake lining is clear of the braking surface on the friction wheel of the mine hoist, and there is a brake applied position when the air pressure holding disc 12 outwards is reduced to its normal level and the disc 12 and shaft 14 move inwardly to apply the brake.

It is known, that in the brake released position the brake lining should be clear of the braking surface, and also that as the brake linings wear there is a position where the mechanism requires adjustment to keep the travel between the brake released position and the brake applied position within predetermined limits. The use of micro-switches, actuated by disc member 12, can give an indication of proper brake release and of the need for brake adjustment. A typical prior art arrangement is shown in FIG. 2.

Referring to FIG. 2, a portion of movable disc member 12 is shown in an opposed relationship with a fixed disc member 16. A diaphragm 17 between disc members 12 and 16 is fixed to the periphery of disc member 17 to provide an air chamber. Air admitted to the air chamber between the surface of disc member 12 and diaphragm 17 pushes against the opposing face of disc member 16 moving the disc member 12 with shaft 14 (FIG. 1) outwardly. In FIG. 2 the brake released position is shown in broken lines and the extreme brake applied position, that is the brake applied position when the brakes need adjustment, is shown in solid line. A mounting arm 18 is fastened to fixed disc member 16 by bolts 19 and extends past the periphery of disc member 16. An L-shaped bracket 20 is mounted by bolts 19A to arm 18 to project in a direction parallel to the direction of movement of disc member 12 and overlying disc members 12 and 16. Two micro-switches 21 and 22 are mounted to bracket 20 with their actuating plungers 23 and 24 facing one another and spaced apart. An actuator 25 is fastened to disc member 12 and projects beyond disc member 12 to terminate in the space between actuating plungers 22 and 23. When the limit switch arrangement just described is set up and operating, the actuator 25 depresses plunger 23 of microswitch 21 when the disc member 12 moves outwardly to the brake released position. Microswitch 21, when actuated, may close (or open) a circuit providing an indication that the brake has released properly. When the brakes are applied, the actuator 25 moves to a position perhaps midway between plungers 23 and 24 when the brakes are newly adjusted, and as the brake linings wear, the actuator 25 moves farther towards plunger 24 in the brake applied condition. When the brakes need adjustment to restore the proper operating parameters, the disc member 12 has moved to such a position in the brakes applied condition that plunger 24 is depressed and microswitch 22 is actuated to close or open a circuit providing an indication that the brakes require adjustment.

It will be seen that the positioning of the microswitches 21 and 22 is critical. These microswitches 21 and 22 have, in the past, been positioned by placing shims between bracket 20 and arm 18, or alternately between disc member and actuator 25. The travel or distance between the brake released position and the brake applied position where brake adjustment is required, is normally a known design distance. Thus the separation or distance between microswitches 21 and 22 is known. However, when the brake engine is first set up the brake release position is not known. If the limit switch assembly, comprising microswitches 21 and 22, bracket 20 and actuator 25 are mounted before the precise position is ascertained and appropriate shimming done, then either microswitch 21 or 22 will be smashed with the first operating cycle. Also, if the brake mechanism is not adjusted immediately a warning indication is issued, a microswitch can be broken by too long a travel. Similarly, when the brake mechanism is adjusted to compensate for brake lining wear, a re-shimming of the limit switch assembly may be required.

The present invention overcomes these difficulties by providing a limit switch assembly which is self-adjusting.

It is therefore an object of the present invention to provide a self-adjusting limit switch for a brake engine.

It is another object of the invention to provide novel limit switch assembly that reduces or prevents damage of microswitches used in the assembly.

SUMMARY OF THE INVENTION

Accordingly there is provided a self-adjusting limit switch assembly for a brake engine having a brake applying and releasing mechanism which moves inwardly and outwardly in a predetermined direction, said limit switch assembly comprising mounting means fixed to said brake engine, slide means mounted to said mounting means for slidable movement in said predetermined direction, operating means connected with said brake applying and releasing mechanism engaging said slide means for moving said slide means outwardly to a brake released position when the brake moves to its released position, at least a first switch means mounted to said slide means for movement therewith and operable by said operating means with movement of said brake applying and releasing mechanism inwardly to apply said brake when said brake requires adjustment because of wear.

BRIEF DESCRIPTION OF THE DRAWINGS

FIG. 1 is an isometric view of a portion of a brake engine for a mine hoist,

FIG. 2 is an elevation of an assembly of limit switches typical of the prior art, FIG. 3 is an isometric view of a self-adjusting limit switch according to the invention, FIGS. 4, 5 and 6 are simplified views of the invention useful in describing the operation of the invention.

DESCRIPTION OF THE PREFERRED EMBODIMENTS

Figure 5:
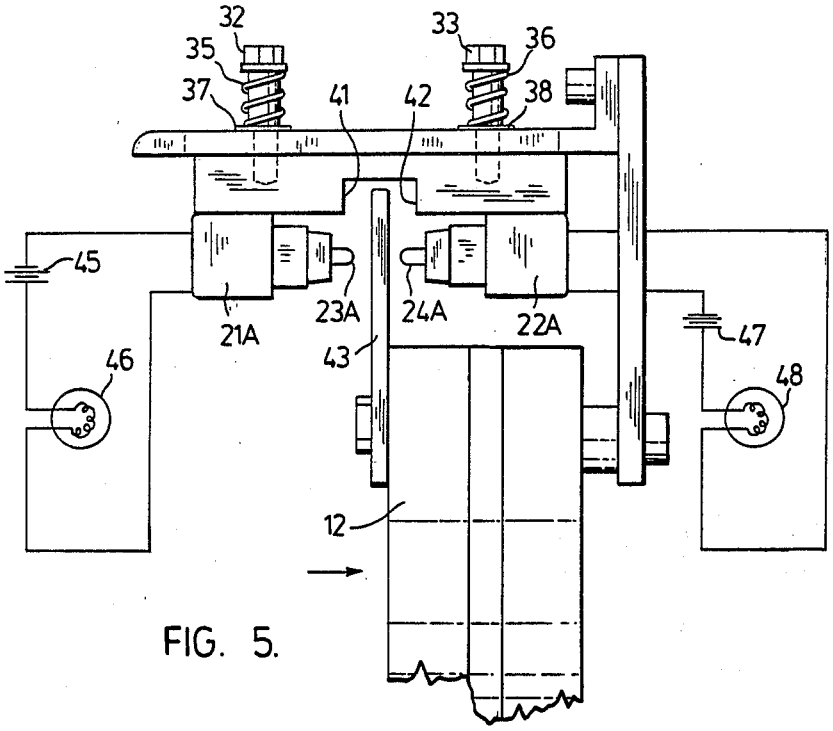

The previous discussed FIGS. 1 and 2 are representative of known prior art limit switch arrangements. A discussion of the present invention referring to FIGS. 3–6 is set forth below.

Referring now to FIG. 3, mounting arm 18 is shown, mounted to the fixed disc member by bolts 19 as before. A mounting bracket 26 is fastened to arm 18 by bolts 27 which extend through the base 28. The mounting bracket 26 has an extending portion 30 which has a longitudinal slot 31 therethrough. Screws 32 and 33 extend through slot 31 into slide 34. Springs 35 and 36 are mounted around screws 32 and 33 respectively and washers 37 and 38 are also on screws 32 and 33. The washers 37 and 38 bear against the extending portion 30 of bracket 26 on either side of slot 31. The springs 35 and 36 are compressed between the heads of screws 32 and 33 and the respective washers 37 and 38. This arrangement mounts slide 34 against extending portion 30 of bracket 26 for sliding movement towards and away from base 28, that is in a direction parallel to the inward and outward movement of disc member 12. The frictional force occurring between washers 37 and 38 and the contacting surface of extending portion 30 of bracket 26 may be changed by selection of springs 35 and 36. The slide 34 has microswitches 21A and 21B mounted to it and spaced from one another. A transverse slot 40 extends across the slide 34 in a direction at right angles to the direction of movement of slide 34 providing facing surfaces 41 and 42, as shown. The actuating plungers 23A and 24A of microswitches 21A and 22A respectively, project past the planes respectively defined by surfaces 41 and 42. This can also be seen in FIG. 5. An actuator 43 is mounted to movable disc member 12 by bolts 44 and it extends past the periphery of disc 12 to terminate in slot 40, as shown, between surfaces 41 and 42. It will be seen that the frictional force between slide 34 and the extending portion 30 of bracket 26 must be greater than the operating force of plungers 23A and 24A of microswitches 21A and 22A. On the other hand, the frictional force must be small enough that the slide 34 can be moved without damage to the slide 34, microswitches 21A, 22A and actuator 43. Normally there is a considerable range of adjustment for the frictional force and selection of suitable springs presents little difficulty.

Figure 6:
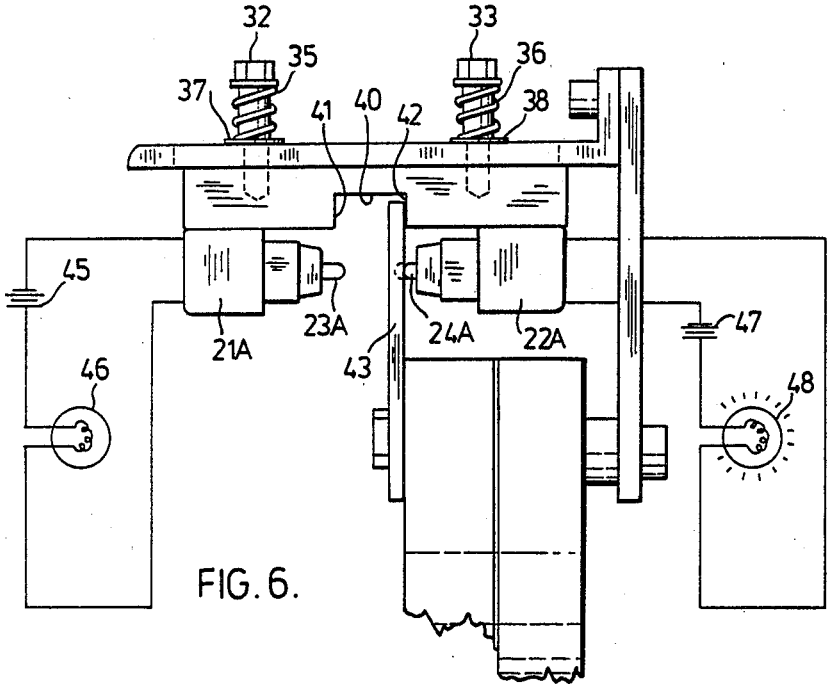

Referring now to FIGS. 4, 5 and 6, the operation of the limit switch assembly will be described. When the brake engine of a mine hoist is assembled, the limit switch assembly is mounted in the arrangement as previously described. The slide 34 can be positioned somewhere in its mid-range with the actuator 43 between the surfaces 41 and 42 of slot 40. The precise position is not important with the limit switch according to the invention. No precise measurements and installation shimmings is normally required. Microswitches 21A and 22A are connected to respective circuits providing an indication for an operator when the switches are either closed or opened. These circuits are shown schematically, for simplicity, as including for microswitch 21A a power source 45 and an indicator light 46, and for microswitch 22A a power source 47 and an indicator light 48.

When the air pressure is applied the first time to release the brakes, the actuator 43 moves outwardly and engages first the actuating plunger 23A of microswitch 21A and then the surface 41 of slot 40. As the actuator 43 continues to move outwardly it carries slide 34 with it until the brake released position is reached. This is the situation shown in FIG. 4. The disc member 12 is in the brake released position and slide has correspondingly been adjusted correctly for that brake released position. The actuating plunger 23A is depressed and indicator light 46 is in a lighted condition indicating the brake is properly released.

Referring to FIG. 5, this shows the situation when the brakes are applied, that is, when the air pressure is released and disc 12 moves inwardly to apply the brakes. The actuator 43 has moved, with disc member 12, until it is in a position roughly mid-way between surfaces 41 and 42. Neither of the microswitches 21A nor 22A is actuated.

As the brake linings wear and the travel between the brake released position and the brake applied position increases, the disc member 12 moves farther inwardly as the brakes are applied. The spacing of the microswitches 21A, 22B is selected so that when the brakes reach a condition requiring adjustment, actuator 43 depresses the actuating plunger 24A of microswitch 22A and the indicator 48 is energized to warn of this condition. This is shown in FIG. 6. The mine hoist would then be stopped and the brakes adjusted to reduce the travel. If the linings require replacement they are replaced. Normally the brakes are adjusted several times before the linings require replacement. It is important to note that the limit switch assembly does not require re-shimming, it adjusts itself to the new conditions.

The limit switch arrangement saves time and simplifies installation. It does not require adjustment by trained personnel when conditions change. Similar arrangements can be used for braking other apparatus than mine hoists.

What we claim as new and desire to secure by Letters Patent of the United States is as follows:

1. A self-adjusting limit switch assembly for a brake engine having a brake applying and releasing mechanism which moves inwardly and outwardly in a first predetermined direction for moving at least one brake shoe to a brake applying position and a brake released position, said limit switch assembly comprising mounting means fixed to said brake engine and having a slot therethrough extending in said first direction, a slide having a first and second side, said first side being in sliding engagement with said mounting means, fastening means extending from said first side of said slide through said slot and engaging said mounting means for mounting said slide to said mounting means for slidable movement in said first direction, said fastening means including spring bias means for providing a frictional force tending to resist movement of said slide, said slide having on said second side first and second surfaces, spaced apart and extending in a second direction at right angles to said first direction, defining a transverse slot, first and second microswitches mounted on said slide and having a respective actuating member extending slightly past a plane defined by said respective first and second surface, an actuator arm extending from said brake applying and releasing mechanism and terminating in said transverse slot, said arm engaging said first surface as the brake applying and releasing mechanism moves outwardly to the brake released position for moving said slide to an adjusted operating position, the actuating member of said first microswitch being operated by said arm when said brake applying and releasing mechanism moves to said brake released position, and the actuating member of said second microswitch being operated by said arm when said brake applying and releasing mechanism moves to said brake applying position and said brake shoe is worn sufficiently to require adjustment.

2. In a friction mine hoist having a friction wheel and a brake engine, the brake engine including at least one piston carrying at an inner end a brake shoe, said piston being arranged for inward and outward movement to press said brake shoe against a surface of said friction wheel in a brake applying position and to raise said brake shoe clear of said surface in a brake released position, a self-adjusting limit switch assembly comprising a bracket fixedly mounted to said brake engine and having a slot therethrough extending in a direction parallel to the direction of inward and outward movement of said piston, a slide on said bracket on a side thereof towards said piston, fastening means extending through said slot and mounting said slide to said bracket for sliding movement there along, said slide having first and second spaced apart and facing surfaces with at least a portion of said facing surfaces lying in first and second planes at right angles to said direction of inward and outward movement, an actuator having a first end secured to said piston for movement therewith and a second end terminating between said first and second surfaces, a first switch mounted to said slide outwardly of said first plane and having an actuating plunger extending slightly past said first plane, a second switch mounted to said slide inwardly of said second plane and having an actuating plunger extending slightly past said second plane, said actuator engaging the actuating plunger of said first switch and said first surface with initial outward movement of said piston to said brake released position for operating said first switch to indicate a satisfactory brake release and to carry said slide to an adjusted brake released position, said actuator moving with inward movement of said piston to said brake applying position to a position between said first and second surfaces when said brake is in adjustment and into engagement with the actuating plunger of said second switch when said brake requires adjustment due to wear.

* * * * *